US006749524B1

(12) United States Patent
Chen

(10) Patent No.: US 6,749,524 B1
(45) Date of Patent: Jun. 15, 2004

(54) STRUCTURES FOR FUSING BALL-STRIKING PLATE WITH SHELL OF GOLF CLUB HEAD

(76) Inventor: Archer C. C. Chen, No. 501, 28Th Road, Taichung Industrial Park, Taichung (TW)

( * ) Notice: Subject to any disclaimer, the term of this patent is extended or adjusted under 35 U.S.C. 154(b) by 252 days.

(21) Appl. No.: 09/590,255

(22) Filed: Jun. 9, 2000

(51) Int. Cl.[7] ..... A63B 53/04
(52) U.S. Cl. ..... 473/342; 473/345
(58) Field of Search ..... 473/342, 340, 473/349, 350, 324, 331, 326, 345, 346, 329; D21/753, 759, 733

(56) References Cited

U.S. PATENT DOCUMENTS 4,768,787 A * 9/1988 Shira ..... 473/331
5,433,440 A * 7/1995 Lin ..... 473/342
5,536,006 A * 7/1996 Shieh ..... 473/342
5,720,673 A * 2/1998 Anderson ..... 473/342
5,967,903 A * 10/1999 Cheng ..... 473/342
6,050,904 A * 4/2000 Kuo ..... 473/342
6,299,549 B1 * 10/2001 Shieh ..... 473/342
6,450,896 B1 * 9/2002 Chen

* cited by examiner

*Primary Examiner*—Sebastiano Passaniti
(74) *Attorney, Agent, or Firm*—Browdy and Neimark, P.L.L.C.

(57) ABSTRACT

A golf club head is made up of a metal shell and a ball-striking plate of a metal material. The shell is provided in the front side with an opening which is provided in the fringe with a projection. The plate is greater in size than the opening of the shell and is provided in the fringe of the back thereof with a recess. The plate is fused with the shell such that the opening of the shell is covered by the plate, and that the projection of the opening is fitted into the recess of the plate.

4 Claims, 3 Drawing Sheets

STRUCTURES FOR FUSING BALL-STRIKING PLATE WITH SHELL OF GOLF CLUB HEAD

FIELD OF THE INVENTION

The present invention relates generally to a golf club head, and more particularly to fusing structures of a ball-striking plate and a shell of the golf club head.

BACKGROUND OF THE INVENTION

As shown in FIG. 1, a prior art golf club head 80 is formed of a shell 81 and a ball-striking plate 83 fused to an insertion slot 82 of the front face of the shell 81. In the fusing process, the shell 81 and the ball-striking plate 83 are fused together by an annular welding portion 84 formed by welding.

As shown in FIG. 2, another prior art golf club head 90 comprises a shell 91 which is provided with an arcuate opening 92 to which a ball-striking plate 93 is attached such that the outer periphery of the back of the plate 93 and the shell 91 form an annular slot 94. The welding is done along the slot 94 to fuse the shell 91 and the plate 93 together.

As shown in FIG. 3, the prior art golf club head, such as the one shown in FIG. 2, is defective in design in that the center of the plate 93 is apt to cave in elastically upon being impacted by an external force, and that the fringe of the plate 93 is elastically curved forward in opposite direction. As a result, the welding portion between the plate 93 and the shell 91 is susceptible to crack.

SUMMARY OF THE INVENTION

The primary objective of the present invention is to provide a golf club head with a ball-striking plate which is securely fused with a shell of the head.

The golf club head of the present invention comprises a metal shell and a metal ball-striking plate. The metal shell is provided in the front portion with an opening. The metal ball-striking plate is fused with the metal shell by welding such that the opening of the metal shell is capped by the ball-striking plate, and that the projected fringe of the opening is fitted into the recessed periphery of the back of the ball-striking plate.

DETAILED DESCRIPTION OF THE INVENTION

Figure 1:
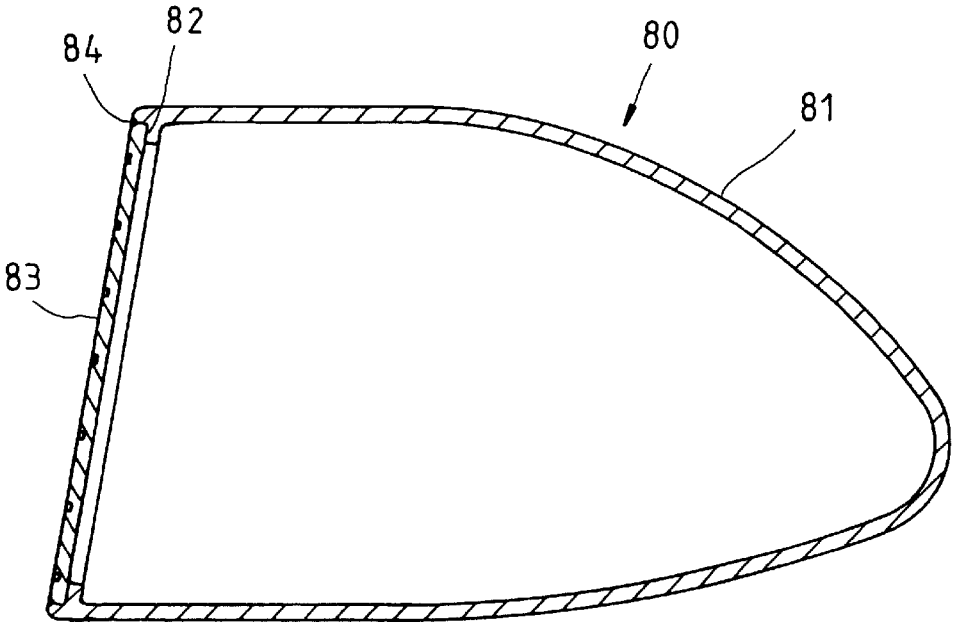
FIG. 1 PRIOR ART
FIG. 1 shows a structural schematic view of a prior art golf club head.
Figure 2:
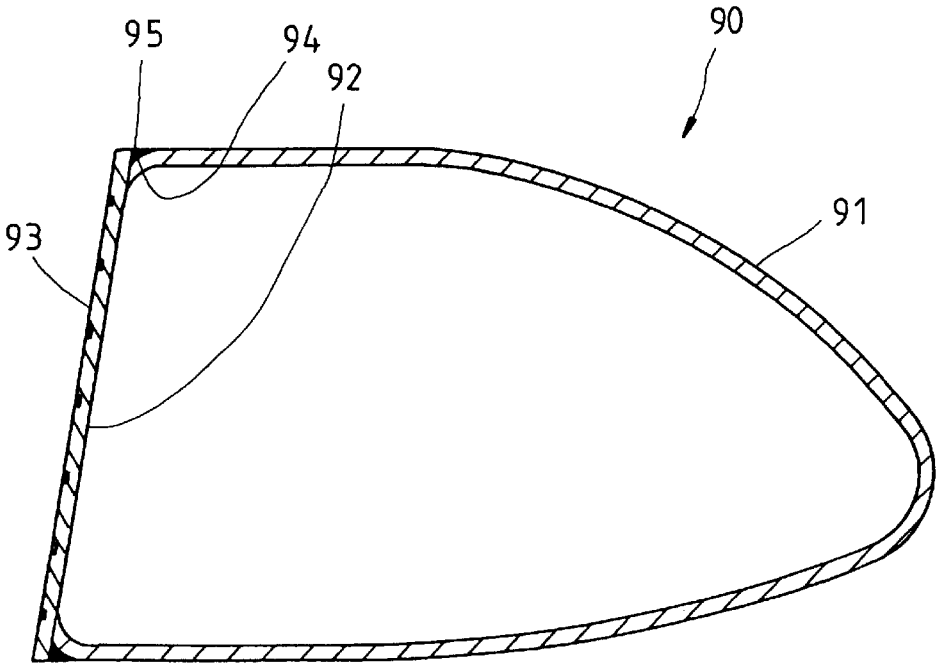
FIG. 2 PRIOR ART
FIG. 2 shows a structural schematic view of another prior art golf club head.
Figure 3:
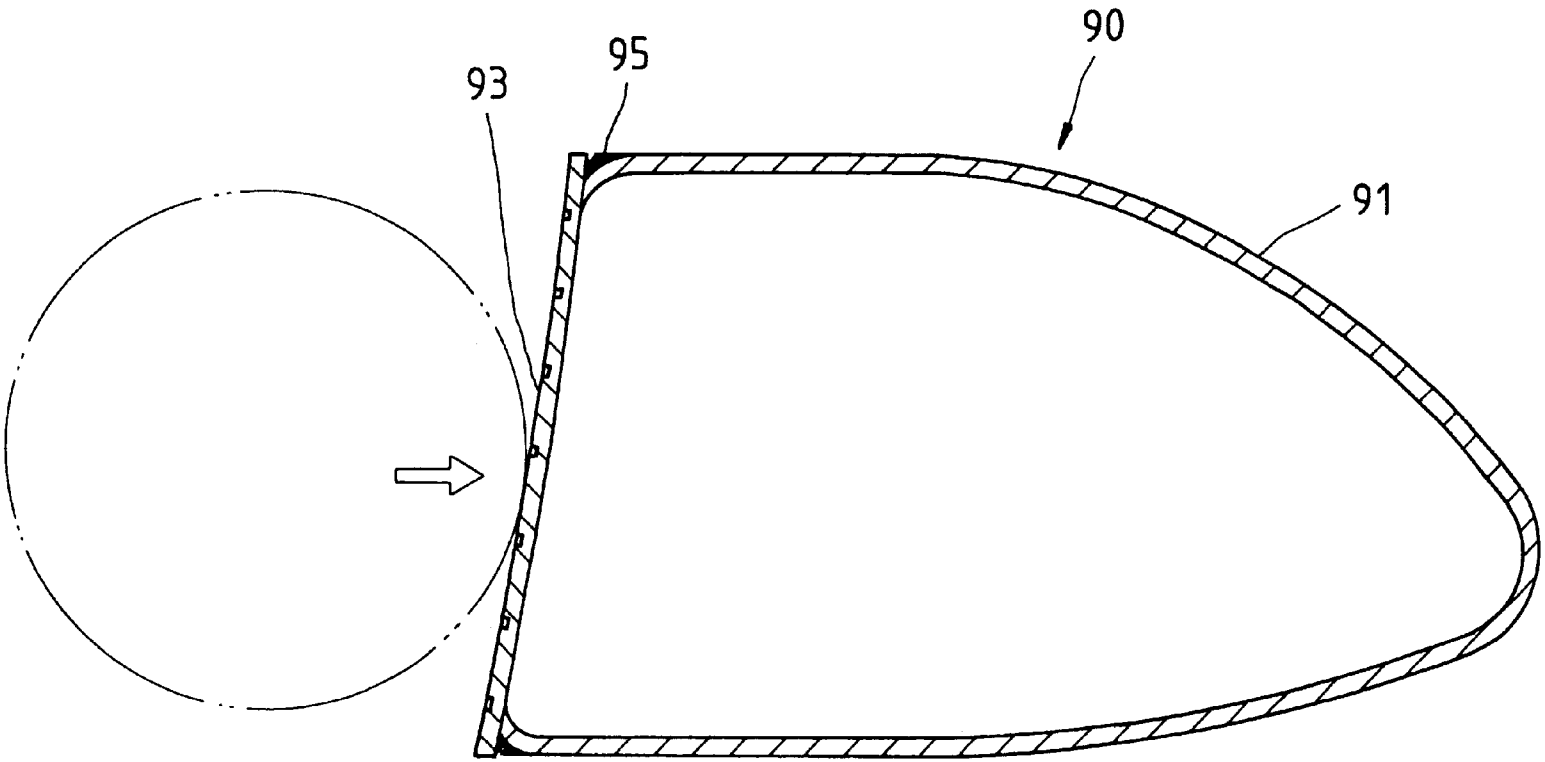
FIG. 3 PRIOR ART
FIG. 3 shows a schematic view of the prior art golf club head of FIG. 1 upon being impacted on by a golf ball.
Figure 4:
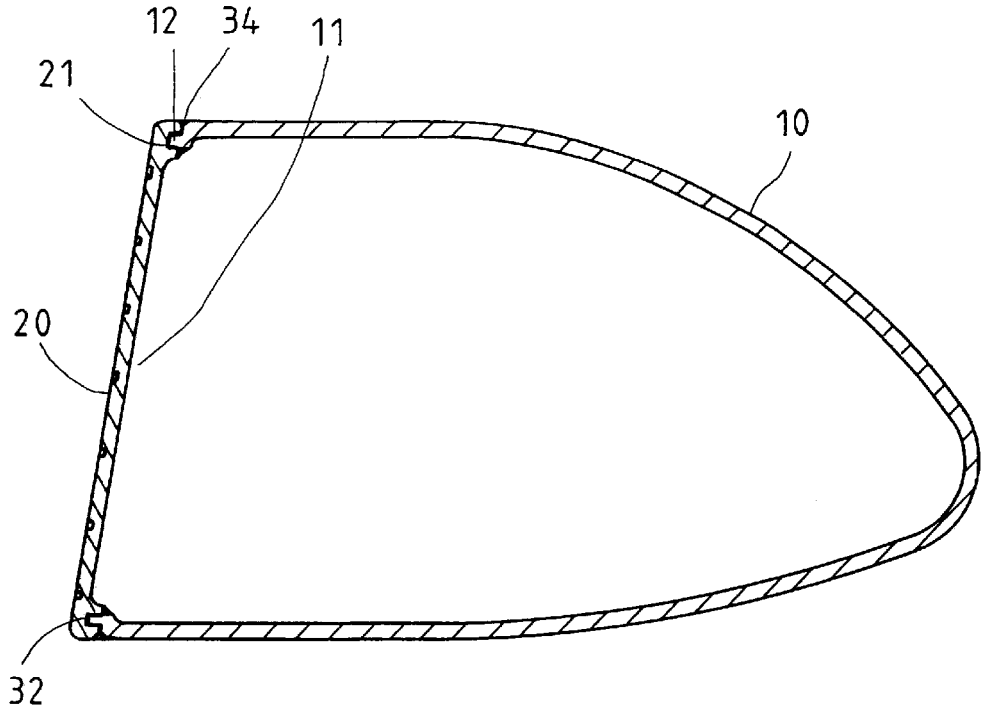
FIG. 4 shows a side sectional view of a first preferred embodiment of the present invention.

As shown in FIG. 4, a golf club head of the first preferred embodiment of the present invention comprises a shell 10 and a ball-striking plate 20.

The shell 10 is integrally made of a stainless steel or titanium alloy by dewaxing and casting. The shell 10 is provided in the front side with an opening 11 which is provided along the fringe with an annular tongue or projection 12.

The ball-striking plate 20 is made of a titanium alloy, stainless steel, or maraging steel by forging, or punching and pressing. The ball-striking plate 20 is slightly greater in size than the opening 11 and is provided along the fringe of the back thereof with an annular groove or recess 21.

The plate 20 is fused with the shell 10 by a soldering portion 32 such that the opening 11 is capped by the plate 20, and that the annular tongue or projection 12 is fitted into the annular groove or recess 21 to form a tongue and groove joint. The fusion of the shell 10 and the plate 20 may be reinforced by a welding portion 34 which is formed by a welding process, such as an argon welding. The soldering portion 32 is formed by brazing and may be lacking.

Figure 5:
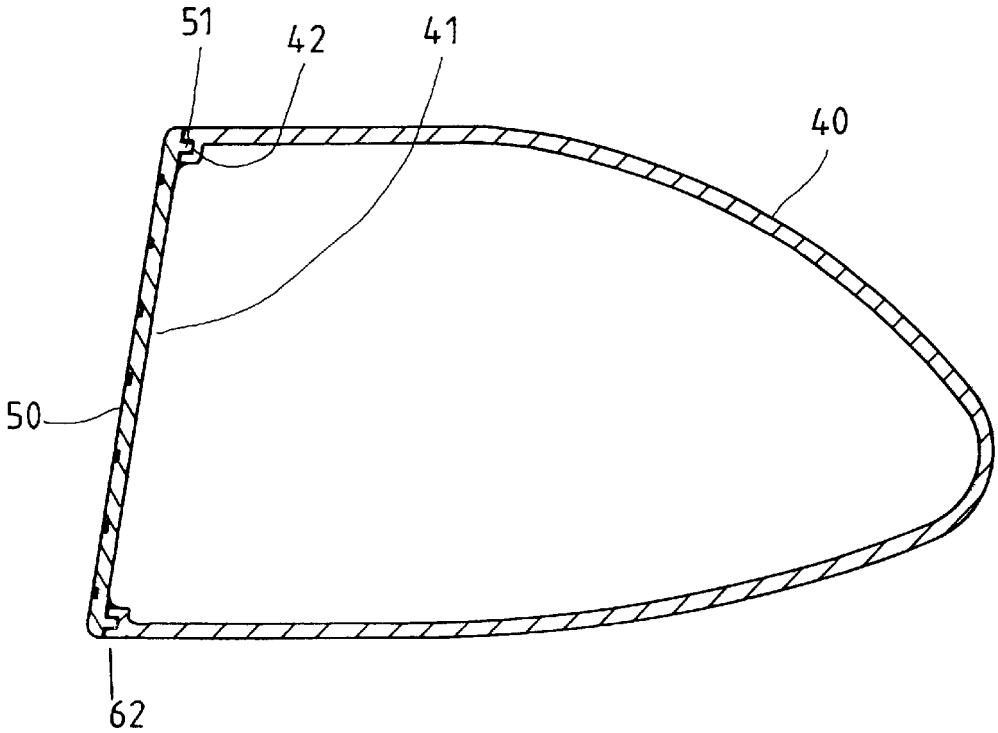
FIG. 5 shows a side sectional view of a second preferred embodiment of the present invention.

As shown in FIG. 5, a golf club head of the second preferred embodiment of the present invention comprises a shell 40 and a ball-striking plate 50. The shell 40 is provided along the fringe of an opening 41 thereof with an annular groove or recess 42, whereas the plate 50 is provided in the fringe of the back thereof with an annular tongue or projection 51. The plate 50 is fused with the shell 40 by a welding portion 62 such that the annular tongue or projection 51 is fitted into the annular groove or recess 42 to form a tongue and groove joint.

The recesses and the projections of the present invention may be bar-shaped and arranged oppositely.

What is claimed is:

1. A golf club head comprising:

a metal shell having a recess;

a fringe circumscribing the recess and projecting inward partially over the recess from a terminal edge of the, metal shell;

the fringe forming an opening into the recess;

an annular projection on the fringe projecting outward away from the recess in a direction parallel to a longitudinal axis of the metal shell;

a ball-striking plate of a metal material having an outer periphery equal to an outer periphery of the metal shell at the terminal edge of the metal shell;

a back side of the ball-striking plate having an annular recess corresponding to the annular projection and opening towards the recess in a direction parallel to the longitudinal axis of the metal shell;

wherein the ball-striking plate and the metal shell exist separately apart from each other and are engaged together only after the annular projection is inserted into the annular recess to form a tongue and groove joint;

wherein the outer periphery of the ball-striking plate abuts against the terminal edge of the metal shell to form a welding portion between the outer periphery of the metal shell at the ball-striking plate and the terminal edge of the metal shell; and wherein the ball-striking plate and the metal shell are thereafter welded together along the welding portion.

2. A golf club head comprising:

a metal shell having a recess;

a fringe circumscribing the recess and projecting inward partially over the recess from a terminal edge of the metal shell;

the fringe forming an opening into the recess;

an annular recess on the fringe opening outward away from the recess in a direction parallel to a longitudinal axis of the metal shell;

a ball-striking plate of a metal material having an outer periphery equal to an outer periphery of the metal shell at the terminal edge of the metal shell;

a back side of the ball-striking plate having an annular projection corresponding to the annular recess and opening towards the recess in a direction parallel to the longitudinal axis of the metal shell;

wherein the ball-striking plate and the metal shell exist separately apart from each other and are engaged together only after the annular projection is inserted into the annular recess to form a tongue and groove joint;

wherein the outer periphery of the ball-striking plate abuts against the terminal edge of the metal case to form a welding portion between the outer periphery of the metal shell at the ball-striking plate and the terminal edge of the metal shell; and wherein the ball-striking plate and the metal shell are thereafter welded together along the welding portion.

3. A golf club head comprising:

a metal shell having a recess;

a fringe circumscribing the recess and projecting inward partially over the recess from a terminal edge of the metal shell;

the fringe forming an opening into the recess;

an annular tongue on the fringe projecting outward away from the recess in a direction parallel to a longitudinal axis of the metal shell;

a ball-striking plate of a metal material having an outer periphery equal to an outer periphery of the metal shell at the terminal edge of the metal shell;

a back side of the ball-striking plate having an annular groove corresponding to the annular tongue and opening towards the recess in a direction parallel to the longitudinal axis of the metal shell;

wherein the ball-striking plate and the metal shell exist separately apart from each other and are engaged together only after the annular tongue is inserted into the annular groove to form a tongue and groove joint;

wherein the outer periphery of the ball-striking plate abuts against the terminal edge of the metal shell to form a welding portion between the outer periphery of the metal shell at the ball-striking plate and the terminal edge of the metal shell; and wherein the ball-striking plate and the metal shell are thereafter welded together along the welding portion.

4. A golf club head comprising:

a metal shell having a recess;

a fringe circumscribing the recess and projecting inward partially over the recess from a terminal edge of the metal shell;

the fringe forming an opening into the recess;

an annular groove on the fringe opening outward away from the recess in a direction parallel a longitudinal axis of the metal shell;

a ball-striking plate of a metal material having an outer periphery equal to an outer periphery of the metal shell at the terminal edge of the metal shell;

a back side of the ball-striking plate having an annular tongue corresponding to the annular groove and opening towards the recess in a direction parallel to the longitudinal axis of the metal shell;

wherein the ball-striking plate and the metal shell exist separately apart from each other and are engaged together only after the annular tongue is inserted into the annular groove to form a tongue and groove joint;

wherein the outer periphery of the ball-striking plate abuts against the terminal edge of the metal case to form a welding portion between the outer periphery of the metal shell at the ball-striking plate and the terminal edge of the metal shell; and wherein the ball-striking plate and the metal shell are thereafter welded together along the welding portion.

* * * * *